United States Patent [19]

Ransom

[11] 4,025,742

[45] May 24, 1977

[54] POSITIVE MECHANICAL LOCK-OUT DEVICE

[75] Inventor: Donald D. Ransom, Portland, Oreg.

[73] Assignee: Allis-Chalmers Corporation, Milwaukee, Wis.

[22] Filed: Aug. 6, 1975

[21] Appl. No.: 602,405

[52] U.S. Cl. ..... 200/48 R; 200/50 C

[51] Int. Cl.² ..... H01H 31/00

[58] Field of Search ..... 200/48 R, 48 A, 48 V, 200/48 CB, 48 SB, 50 C, 50 R

[56] References Cited

UNITED STATES PATENTS 3,038,052 6/1962 Froland ..... 200/50 C

*Primary Examiner*—Herman Hohauser

*Attorney, Agent, or Firm*—Robert C. Jones

[57] ABSTRACT

Sequential operation of a pair of switches in a required sequence of operation is ensured by means of a telescoping arrangement of tubes which are connected to associated ones of switch operating shafts. A positive stop prevents the movement of one telescoping member relative to the other out of sequential order.

5 Claims, 3 Drawing Figures

POSITIVE MECHANICAL LOCK-OUT DEVICE

BACKGROUND OF THE INVENTION

This invention relates to a high voltage switch assembly, and more particularly, to such an assembly having grounding switch means associated therewith and to a positive mechanical lock-out means for preventing the operation of the associated switches out of proper sequence.

Prior arrangements for switches of the type generally indicated have been characterized by various disadvantages, one of the principal ones of which is that they are normally quite complicated and costly requiring numerous parts, all of which make the lock-out subject to failure. Also, switches of the type generally indicated are normally assembled at the installation site and are thus subject to dimensioned variations, thus making it extremely difficult and time consuming to field-fit a lock-out device with the switch assembly.

A general object of the present invention is to provide a novel lock-out arrangement for a switch assembly which resolves the problems set forth in a practical and satisfactory manner.

More specifically, it is an object of the present invention to provide an improved adjustable lock-out arrangement for a switch assembly which easily adapts to the structure in the field.

Still another object of the present invention is to provide an improved lock-out which is inexpensive to manufacture and simple in operation.

Yet another object of the present invention is to provide a switch lock-out which requires no special tools to assemble.

A further object of the invention is to provide a lock-out arrangement for a switch assembly which has relatively few moving parts.

SUMMARY OF THE INVENTION

According to the preferred arrangement of the invention, the proposed lock-out comprises a pair of interfitting telescoping tubular members each of which are connected to respective ones of switch operating shafts. A single piece coupling member is operably connected to each tubular member and to the associated switch actuating shaft remote from the switch itself. A positive stop is adjustably secured to one of the tubular members and is operative to prevent the movement of one of the tubular members relative to the other in selective directions.

DESCRIPTION OF THE INVENTION

Figure 1:
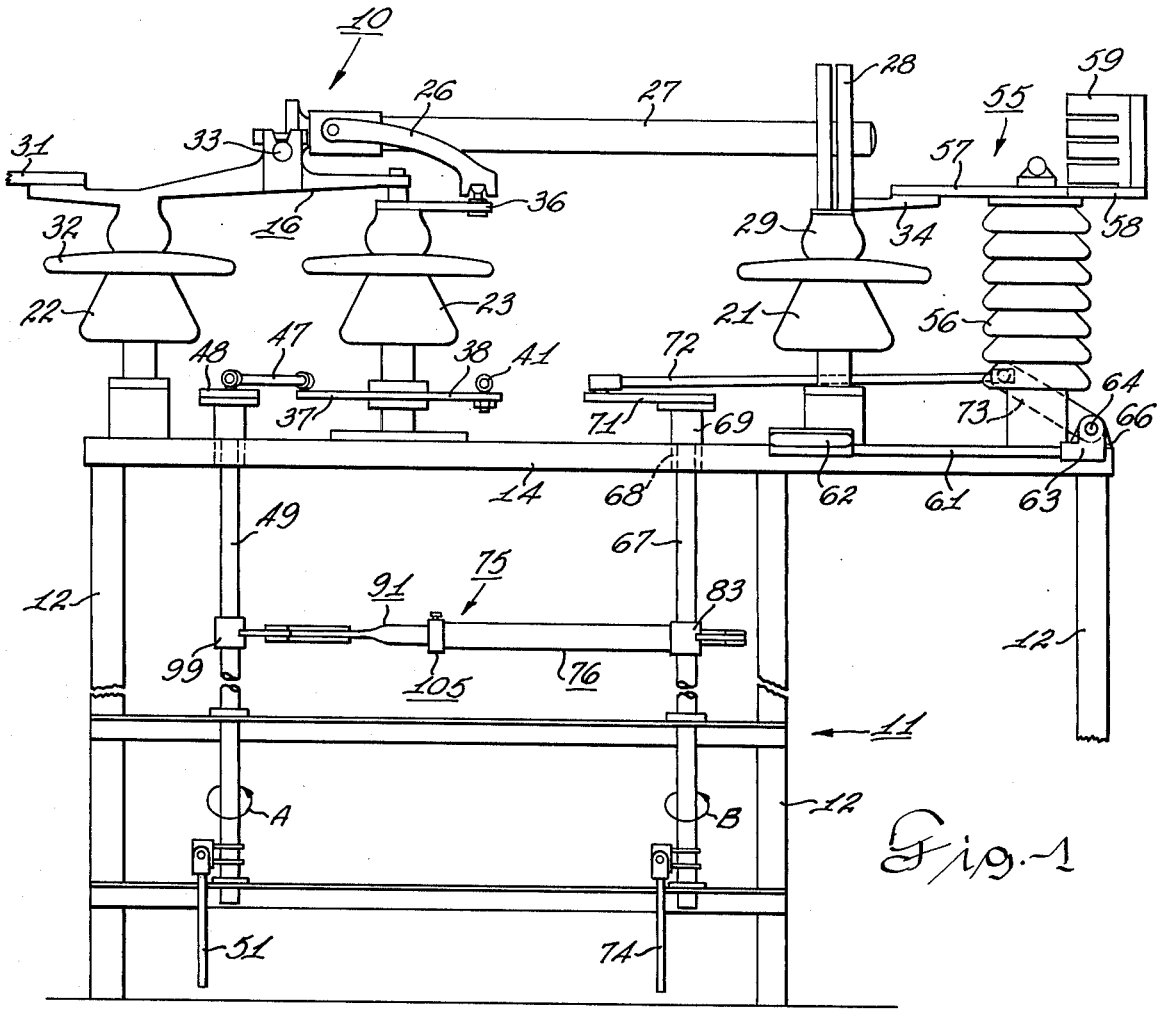
FIG. 1 is a view in side elevation of a multipole airbreak switch assembly showing one pole of the assembly and an associated grounding switch with the lock-out arrangement.

As shown in FIG. 1 of the drawings, the switch assembly 10 is carried in an elevated position above the ground surface by a supporting structure 11. The supporting structure 11 includes a plurality of upstanding legs 12, two of which are shown, on which a skeleton type platform 14 arrangement is secured. A plurality of vertical break disconnect switches 16, one per phase, are supported in operative spaced apart relationship on the platform 14. The disconnect airbreak switches 16, one per phase, are identical constructions and operations; thus, only one switch is illustrated and the description of the disconnect switch 16 will apply to all of the switches.

The disconnect switch 16 includes two vertical outboard insulators 21 and 22 which are stationary, and an inboard vertical rotating insulator 23. The insulators 21, 22 and 23 are carried on the platform 14. Operating means 26 for moving the contact blade 27 between open and closed positions is actuated by rotation of the inboard insulator 23. In closed position, the contact blade 27 is in electrical engagement with the contact fingers of a stationary contact 28 carried on a metallic cap 29 that is cemented to the top of the upstanding insulator 21. Current transfer through the switch 16 is from the rear terminal connection 31 to which a power line (not shown) is connected. The rear terminal 31 is secured to an insulator cap 32 which is cemented to the top end of the associated insulator 22. Current flow from the rear terminal 31 is through the contact hinge 33 passing through the tubular blade 27 to the stationary contact 28 and thence through a front terminal 34 associated with the stationary contact 28. The front terminal 34 associated with the stationary contact 28 is adapted to receive a power line (not shown) in the usual well-known manner.

In operation, the blade 27 is constructed and arranged to rotate and lift to a vertical full open position. Such motion is imparted to the blade 27 by means of a toggle linkage 36 which is actuated by rotation of the insulator 23. Rotation of the insulator 23 transfers force from the switch base to the blade. The rotational force is imparted to the insulator 23 through an arm 37. Since the disconnect switches 16 are the same, each is provided with similar insulator actuating arms 37. Thus, each switch may be actuated individually or all of the switches may be operated to open or closed positions simultaneously. For simultaneous operation of the switches, a common linking rod 41 is pivotally connected to an arm 38 which is formed integrally with the arm 37, but extends outwardly in the opposite direction from the direction that the arm 37 extends.

A control rod 47 is operatively connected to the extending end of the input arm 37 of one of the switches. The opposite end of the control rod 47 is operatively connected to a crank 48 which is connected to be rotated by means of a vertical control shaft 49 that extends downwardly to a convenient operating personnel height. At the lower end of the shaft 49 there is provided a swing handle 51 which is pivotally severed to the control shaft 49. The operator will raise the handle 51 into the horizontal plane and in doing so will effect a drive connection between the handle 51 and the shaft 49. By moving the shaft 49 approximately 180° by means of handle 51 and in the direction indicated by the rotational direction arrow A, the insulator 23 will be rotated to effect a partial rotation of the blade 27 and subsequently the swinging upward movement of the blade from the horizontal closed position to a vertical open position.

Associated with each disconnect switch 16 is a grounding switch 55. Each grounding switch 55 is identical and all may be operated simultaneously. The grounding switch 55 comprises an upstanding insulator 56 which is supported on the platform 14. At its upper end, the insulator 56 is provided with an L-shaped contact base 57 that is secured to the insulator. The leftwardly extending end of the ground switch contact base 57 is electrically connected to the stationary contact terminal 34 of the disconnect switch 16. The short leg 58 of the L-shaped base 57 extends forward toward the viewer in FIG. 1 and supports a multifingered stationary contact 55. A grounding contact rod 61 is supported for swinging movement from an open position as depicted in FIG. 1 to a vertical closed position. With the grounding contact rod in a vertical closed position, a contact pad 62 electrically connected to the rod 61 will be in full electrical engagement with the contact fingers of the stationary contacts 59. The grounding circuit is established from the contact plate 57 through the multifinger contact, the contact pad 62 and thence through the grounding contact rod 61. At its lower end, the grounding contact rod 61 is secured in a metallic pivot hinge 63 which, in turn, is secured to an elongated metallic rod 64 for rotation with the rod. The metallic rod 64 is rotatably supported in a plurality of trunnions 66, one of which is shown. The trunnions 66 are spaced along the platform 14 to give adequate support to the rod. Thus, the grounding circuit is from the rod 61 through the metallic hinge 63, rod 64, trunnions 66 to the metallic legs 12 of the support 11 to ground.

Rotation of the shaft 64 to effect pivotal movement of the grounding rod 61 between open and closed positions is effected by means of a vertical shaft 67 that is rotatably supported by the support structure 11 in suitable bearings 68. At its upper end, the shaft 67 is provided with a flanged collar 69 that is secured to the shaft to rotate with it. An arm member 71 is secured to the top surface of the flanged collar 69 and extends outwardly therefrom. At its free end, the arm member 71 has a pivotal driving connection with an elongated drive rod 72. At its opposite end, the drive rod 72 is pivotally connected to one end of a rod operating lever 73. The opposite end of the operating lever 73 is connected to the shaft 64 in a manner that arcuate movement of the operating lever 73 will effect rotation of the rod 64. Thus, by rotating the shaft 67 in a counterclockwise direction, as viewed in FIG. 3 and in the direction indicated by the directional arrow B in FIG. 1, the arm 71 will be pivoted to displace the rod 72 to the right, as viewed in FIG. 1. Rightward displacement of the rod 72 will move the operating lever 73 in an arcuate path in a clockwise direction from the position it occupies in FIG. 1. Clockwise movement of the operating lever 73 effects rotation of the rod 64 in a clockwise direction thereby swinging the grounding rod 61 upwardly into engagement with the multifingered stationary contact 59 to establish a grounding circuit. To effect rotation of the shaft 67, there is provided a handle 74 which is similar to the handle 51. Thus, by raising the handle 74 into a horizontal plane, a driving connection will be established between the handle and the shaft 67.

In switch arrangements of the type described, a positive means must be provided to ensure the proper sequential operations of the switches. In other words, a positive means must be provided to ensure that the disconnect switch 16 is operated to open position prior to the ground switch 55 being operated to a closed position, and, in the opposite sense that the ground switch is opened before the disconnect switch is closed. Such means must not only be continuously operable to positively prevent the switches from being operated in the wrong order, but must also be efficient, easily adaptable to field installation, positive in operation and relatively inexpensive to manufacture and maintain. In both manufacturing and field erection tolerances, the structure will vary considerably making it extremely difficult to provide a simple field adaptable interlock.

Figure 3:
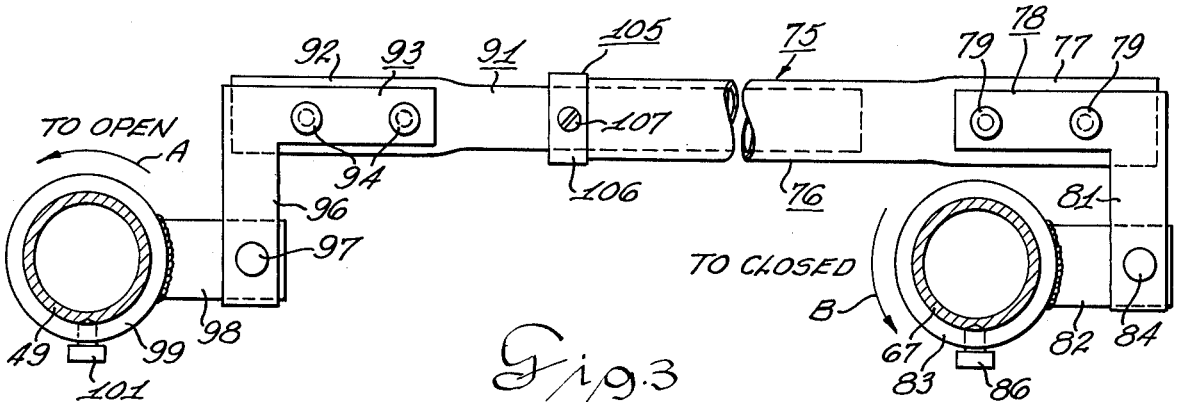
FIG. 3 is an enlarged detail view in plan of the lock-out arrangement shown in FIG. 2.
Figure 2:
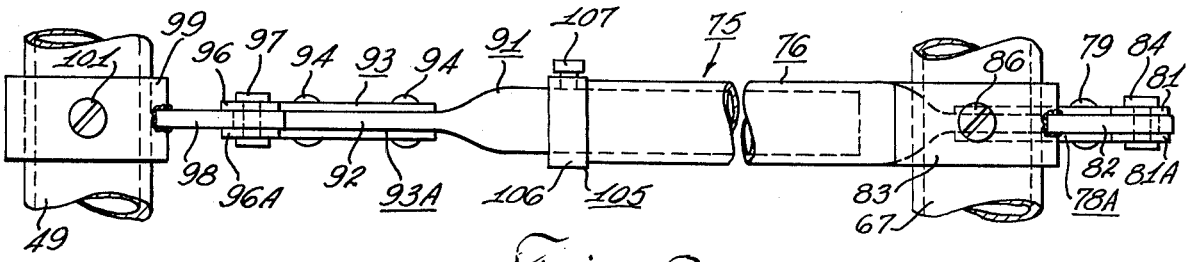
FIG. 2 is an enlarged view in side elevation of the lock-out arrangement showing the relationship of the components with respect to the operating shafts associated with the airbreak switch in closed position and the ground switch in open position.

As shown in FIGS. 2 and 3, a lock-out means 75 is depicted which meets all the desired requirements. The lock-out means 75 includes an elongated tubular sleeve member 76. As viewed in FIGS. 2 and 3, the right end of the sleeve member 76 is flattened as at 77 and receives a pair of L-shaped brackets 78 and 78A which are disposed on each side of the flat portion 77. The L-shaped brackets 78 are secured on the flat portion 77 of the sleeve 76 by means of bolts or rivets 79. It will, of course, be recognized that any other means may be used to secure the brackets to the sleeve. The free leg portions 81 of the L-shaped brackets 78 are disposed on each side of a lever arm 82 extending outwardly from a coupling or collar member 83. The free leg portions 81 are pivotally connected to the extending end of the lever arms as by a pivot pin 84. The lever arm 82 is welded to the collar member 83 so as to move with the collar. As shown, the collar member 83 is mounted on the shaft 67 and is secured to rotate with the shaft 67 as by a screw 86.

A cooperable tube or rod 91 is disposed in telescoping arrangement within the sleeve 76. The leftwardly extending end of the tube 91 is flattened as at 92 and receives the legs of a pair of L-shaped brackets 93 and 93A on either side thereof. The brackets 93 and 93A are secured to the flattened end of the tube 91 by means of rivets 94. The legs 96 and 96A of the L-shaped brackets 93 and 93A, respectively, which extend outwardly toward the viewer in FIG. 2, and downwardly as viewed in FIG. 3, are pivotally secured by means of a pivot pin 97 to the extending end of a lever arm 98. The lever arm 97 is welded to a coupling or collar 99 which is adapted to be mounted on the shaft 49. A screw 101 threadedly engaged in a suitable threaded opening in the collar 99 locks the collar 99 to the shaft 49 in a vertical position and in a manner that the collar will rotate with the shaft 49.

As previously mentioned, the interlock means 75 as provided must operate to ensure the operation of the switches 16 and 55 in a sequential order in a first direction and also in a reverse sequential order in a second direction. To this purpose, a positive stop means 105 is provided and mounted on the tube 91. The positive stop means 105 depicted herein includes a collar 106 that is mounted about the tube 91. A lockscrew 107 threaded through the collar 106 engages the tube 91 to secure the collar 106 in an adjusted operative position, which position is normally in abutting engagement with the end of the sleeve 76.

In operation, the disconnect switch 16 is operated from the closed position that is in FIG. 1 to an open position. This is accomplished by rotating the shaft 49 in a counterclockwise direction as indicated by the directional arrow in FIG. 3. As the shaft 49 is rotated in a counterclockwise direction to open the switch 16, the collar 99 rotates with the shaft. As a result, the lever arm 98 operates to displace the tube 91 leftwardly. As the lever arm 98 moves angularly with the collar 99, it will tend to effect an adjustment of the sleeve 76 about the pivot pin 84 to maintain the sleeve 76 and the telescoping tube 91 in substantially axial alignment as the telescoping tube 91 is drawn out of the sleeve. As the telescoping tube 91 moves leftwardly, as viewed in FIGS. 2 and 3, the positive stop 105 moves with the telescoping tube 91 releasing the sleeve 76. Thus, when the disconnect switch 16 is in its full open position, the telescoping tube 91 will have been displaced leftwardly a distance sufficient to position the positive stop 105 to allow the sleeve 76 to move to the left. Thus, with the disconnect switch 16 in full open position, it is now possible to rotate the shaft 67 in a counterclockwise direction, as viewed in FIG. 3, and to operate the grounding switch 55 to a closed position. This is true because the positive stop 105 has been displaced to the left with the telescoping tube 91 thereby releasing the sleeve 76 for leftward movement. With the grounding switch 55 in full closed position, the sleeve 76 will be in a leftward position again abutting the positive stop 105. With this condition obtained, it is impossible to close the disconnect switch 16 until such time as the grounding switch 55 has been operated first in the sequence of the second direction. The lock-out 75 is thus effective to ensure the proper sequential operation of the switch in both directions and materially aids in preventing accidental or inadvertent misoperation.

In addition, the lock-out 75 is particularly well adapted for field assembly. As can be seen, it is only necessary to install the collars 83 and 99 on the associated shafts 67 and 49 when the switch assembly 10 is being erected in the field. After the switch assembly 10 has been fully assembled, the sleeve 76 and the associated telescoping tube 91 are assembled with the positive stop loose on tube 91. The ends of the intermeshed tubes are then pivotally connected to the level arms 82 and 98. With the interlock assembly being complete, the positive stop 105 is moved in position abutting the end of the sleeve 76 and locked in that position. With the telescoping arrangement between the sleeve 76 and the telescoping tube 91, the interlock is particularly well suited for installation where distance between the switch operating shafts vary considerably.

The embodiments of the invention in which an exclusive property or privilege is claimed are defined as follows:

1. In a lock-out arrangement to ensure sequential operation of a pair of switches in a first direction;

first and second interconnected members constructed and arranged for movement relative to each other;

said first member being a sleeve operably connected to move in a first direction with the operation of its associated switch in a first direction;

said second member being configured to slidably fit within said first sleeve member and operably connected to move in the first direction with the operation of its associated switch in the first direction; and, a positive stop secured to one of said members and operable to effectively prevent the movement of said members relative to each other in a first direction until the switch which is to operate first in the sequence in the first direction has been operated.

2. A lock-out arrangement according to claim 1 wherein said first means includes a cylindrical sleeve member operably connected to be moved in a first direction with the movement of its associated switch in the first direction;

said second means including a cylindrical member disposed within said sleeve member for movement relative to said sleeve member, said cylindrical member being operably connected to be moved relative to said sleeve member in a first direction with the movement of its associated switch in the first direction; and, said positive stop includes an abutment on said cylindrical member disposed in engagement with said cylindrical sleeve member and operative to prevent the movement of said cylindrical member relative to said cylindrical sleeve member in the first direction until said cylindrical sleeve member has been displaced in a first direction by the operation of its associated switch in the first direction.

3. In a lock-out arrangement for ensuring sequential operation of a dual switch arrangement, in which each of the switches have independent operating members disposed in spaced-apart relationship;

a first axially movable member operably connected to the first of the switch operating members that is associated with the first of the switches which is to be moved first in the sequence of switch operation in a first direction;

a second axially movable member operably connected to the second of the switch operating members that is associated with the second of the switches which is to be moved secondly in the sequence of switch operation in the first direction, said first and second axially movable members are in telescoping relationship and each having their free ends connected to an associated one of the switch operating members in a manner to be moved axially by its associated operating member; and, a positive stop adjustably secured on said second axially movable member for selective positioning relative to said first axially movable member so as to be in engagement with said first axially movable member and operable to positively prevent the movement of said first axially movable member relative to said second axially movable member until the first switch has been operated first in the sequence.

4. A lock-out arrangement according to claim 3 including:

a coupling member attached to each of the switch operating members;

a lever arm secured to each of said coupling members; and,

L-shaped bracket members having one of their legs secured to the free ends of an associated one of the axially movable members, said L-shaped bracket members having their opposite legs pivotally secured to the free end of an associated one of said lever arms.

5. In a lock-out arrangement for ensuring sequential operation of a dual switch arrangement, in which each of the switches have independent operating members disposed in spaced apart relationship;

a first axially movable member operably connected to the first of the switch operating members that is associated with the first of the switches which is to be moved first in the sequence of switch operation in a first direction;

a second axially movable member operably connected to the second of the switch operating members that is associated with the second of the switches which is to be moved secondly in the sequence of switch operation in the first direction, said second axially movable member being slidably interengaged with said first axially movable member; and, a positive stop on said second axially movable member in engagement with said first axially movable member and operable to positively prevent the movement of said first axially movable member relative to said second axially movable member until the first switch has been operated first in the sequence.

* * * * *